US005455560A

United States Patent [19]

Owen

[11] Patent Number: 5,455,560

[45] Date of Patent: Oct. 3, 1995

[54] MEANS FOR LOCATING A REMOTE CONTROL DEVICE

[76] Inventor: C. Randal Owen, P.O. Box 148, Bragg City, Mo. 63827

[21] Appl. No.: 201,685

[22] Filed: Feb. 25, 1994

[51] Int. Cl.[6] ..... G08B 1/08

[52] U.S. Cl. ..... 340/539; 340/572; 340/825.49; 348/734

[58] Field of Search ..... 340/539, 531, 340/825.49, 825.35, 825.69, 825.72, 572, 692; 348/734

[56] References Cited

U.S. PATENT DOCUMENTS

| | | | |
|---|---|---|---|
| 4,101,873 | 7/1978 | Anderson et al. | 340/539 |
| 4,476,469 | 10/1984 | Lander | 340/539 |
| 5,294,915 | 3/1994 | Owen | 340/539 |

*Primary Examiner*—Donnie L. Crosland

*Attorney, Agent, or Firm*—Haverstock, Garrett & Roberts

[57] ABSTRACT

A locating device for locating a remote control device which is capable of controlling an electronic device, the electronic device being stationary and the remote control device being capable of controlling the electronic device from a remote location, is disclosed. The locating device comprises a transmitter portion incorporated with the electronic device and a receiver portion which is located within the remote control device. The transmitter portion comprises circuitry for transmitting a signal. The receiver portion comprises a first oscillator circuit which is adapted to oscillate when the transmitted signal is at the design center frequency of the first oscillator circuit. The receiver portion further comprises a second oscillator circuit which is adapted to begin oscillation after the first oscillator circuit begins to oscillate. The signal from the second oscillator circuit is amplified and provided to an audio oscillator circuit. A method of coding the signals is also disclosed.

19 Claims, 5 Drawing Sheets

MEANS FOR LOCATING A REMOTE CONTROL DEVICE

BACKGROUND OF THE INVENTION

The present invention relates to a means for locating a remote control device and in particular to an audible means for locating a remote control device with the locating means including timing means.

Various electronic devices such as televisions, stereos, video cassette recorders and the like, are capable of being controlled from remote locations by use of a hand held remote control device. Remote control devices are capable of generating signals, such as infrared or RF (radio frequency), for transmission to the electronic device. The electronic device is adapted to receive the transmitted signal and based upon the received signal to operate a function of the electronic device, such as change a channel, increase the volume, or turn the device on or off. Although remote control devices are useful, one problem associated with their use is because of their small size they are easily lost or misplaced. Even though there are now companies that manufacture and sell universal replacement remote controls, these remote controls sometimes do not have all the functions of the lost remote control and the user would have to become familiar with operating the replacement remote control. There have been various devices proposed in the prior art for assisting in locating lost or misplaced objects some of which are disclosed in U.S. Pat. Nos. 4,101,873; 4,421,319; and 4,476,469. However, such devices are of complicated designs and would be expensive to implement in existing remote control devices and electronic devices. Therefore, it would be advantageous to have a means for locating a remote control device that is of simple design and could be easily incorporated within remote control devices and incorporated with electronic devices.

SUMMARY OF THE INVENTION

The means for locating a remote control device of the present invention is designed and intended for use with a remote control device which is capable of controlling a typically stationary electronic device. The means for locating a remote control device comprises a transmitter portion incorporated with the electronic device, the transmitter portion comprising means for generating a signal for a predetermined period of time, and means for transmitting the signal and a receiver portion located within the remote control device, the receiver portion comprising means for receiving the transmitted signal, a first oscillator means for receiving the signal from the receiving means, the first oscillator means adapted to oscillate when the transmitted signal is at the design center frequency of the first oscillator means, a second oscillator means responsive to the first oscillator means oscillating, the second oscillator means adapted to oscillate after the first oscillator means begins to oscillate, means for amplifying the signal from the second oscillator means, and means for providing the amplified signal to an audio oscillator means, the audio oscillator means for generating audio signals indicating that the signal has been received.

In another form of the present invention the means for locating a remote control device comprises a transmitter portion incorporated with the electronic device, the transmitter portion comprising means for generating a signal for a predetermined period of time, means for transmitting the signal, and means for stopping the transmission of the signal prior to the expiration of the predetermined period of time, and a receiver portion located within the remote control device, the receiver portion comprising means for receiving the transmitted signal, a first oscillator means for receiving the signal from the receiving means, the first oscillator means adapted to oscillate when the transmitted signal is at the design center frequency of the first oscillator means, a second oscillator means responsive to the first oscillator means oscillating, the second oscillator means adapted to oscillate after the first oscillator means begins to oscillate, means for amplifying the signal from the second oscillator means, and means for providing the amplified signal to an audio oscillator means, the audio oscillator means for generating audio signals indicating that the signal has been received.

In another form of the present invention the means for locating a remote control device comprises a transmitter portion incorporated with the electronic device, the transmitter portion comprising means for generating a signal for a predetermined period of time, means for coding the signal, the coding means comprising a set of fusible links for selecting a code, the code being selected by inserting or removing any or all of the fusible links, means for transmitting the coded signal, and means for stopping the transmission of the coded signal prior to the expiration of the predetermined period of time and a receiver portion located within the remote control device, the receiver portion comprising means for receiving the transmitted coded signal, a first oscillator means for receiving the coded signal from the receiving means, the first oscillator means adapted to oscillate when the transmitted coded signal is at the design center frequency of the first oscillator means, a second oscillator means responsive to the first oscillator means oscillating, the second oscillator means adapted to oscillate after the first oscillator means begins to oscillate, means for amplifying the coded signal from the second oscillator means, means for determining that the coded signal has been received, the determining means comprising means for comparing the coded signal to a code, means for verifying that the coded signal corresponds to the code, and means for providing a signal to an audio oscillator means once the coded signal has been verified, the audio oscillator means for generating audio signals indicating that the coded signal has been received and verified.

In light of the foregoing comments, it will be recognized that a principal object of the present invention is to provide an improved means for locating a remote control device.

A further object of the invention is to provide means for locating a remote control device which is of simple construction and design and which can be easily employed with highly reliable results.

Another object of the invention is to provide means for locating a remote control device which is easily incorporated into existing remote control devices and incorporated with electronic devices which are controlled by the remote control.

A further object of the invention is to provide means for locating a remote control device which allows the user to verify that the device is operating and which allows the user to control operation of the device.

These and other objects and advantages of the present invention will become apparent after considering the following detailed specification in conjunction with the accompanying drawings, wherein:

DETAILED DESCRIPTION OF THE PREFERRED EMBODIMENTS

Figure 1:
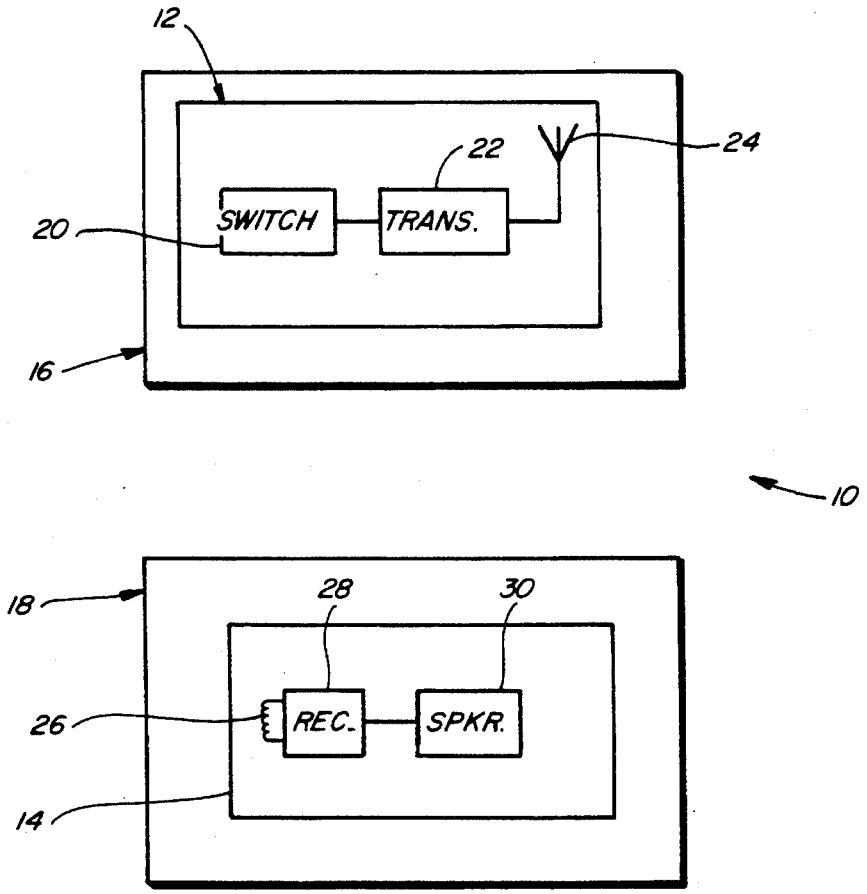
FIG. 1 is a block diagram of a preferred embodiment of means for locating a remote control device of the present invention.

Referring now to the drawings, wherein like numerals refer to like items, number 10 identifies a preferred embodiment of the means for locating a remote control device of the present invention. With reference to FIG. 1, the locating means 10 includes a transmitter portion 12 and a receiver portion 14. The transmitter portion 12 is embodied or incorporated in an electrical or electronic device 16, such as a television, stereo system, VCR, or the like which is optionally controlled by a hand held remote control device 18. Although the transmitter portion 12 is shown being incorporated in the electronic device 16 it is also contemplated that the transmitter portion 12 be a separate unit to be placed on or attached to the outside casing of the electronic device 16 or close to the electronic device 16. The receiver portion 14 is shown embodied or incorporated in the remote control device 18.

The transmitter portion 12 includes a switch 20, transmitting circuitry 22 connected to the switch 20, and an antenna 24 connected to the transmitting circuitry 22. When the switch 20 is actuated the transmitting circuitry 22 sends signals out over the antenna 24. The receiver portion 14 includes a coil 26 connected to receiving circuitry 28, and signaling means such as a speaker 30 connected to the receiving circuitry 28. The coil 26 receives signals sent from the transmitter portion 12 and the receiving circuitry 28 operates the speaker 30 upon receipt of the transmitted signal.

As is known, the remote control device 18 controls functions associated with the electronic device 16. The electronic device 16 is typically a stationary device located at a single location. The hand held remote control device 18 is a relatively easily movable device which is capable of being positioned or taken to various locations remote from the electronic device 16 to operate the electronic device 16. There are various methods of signaling between the electronic device 16 and the remote control device 18. One method is to use infrared signals which are transmitted from the remote control 18 and received by the electronic device 16. Another method would be to use signals in the FM (frequency modulation) band. Other signaling methods are also known.

Figure 2:
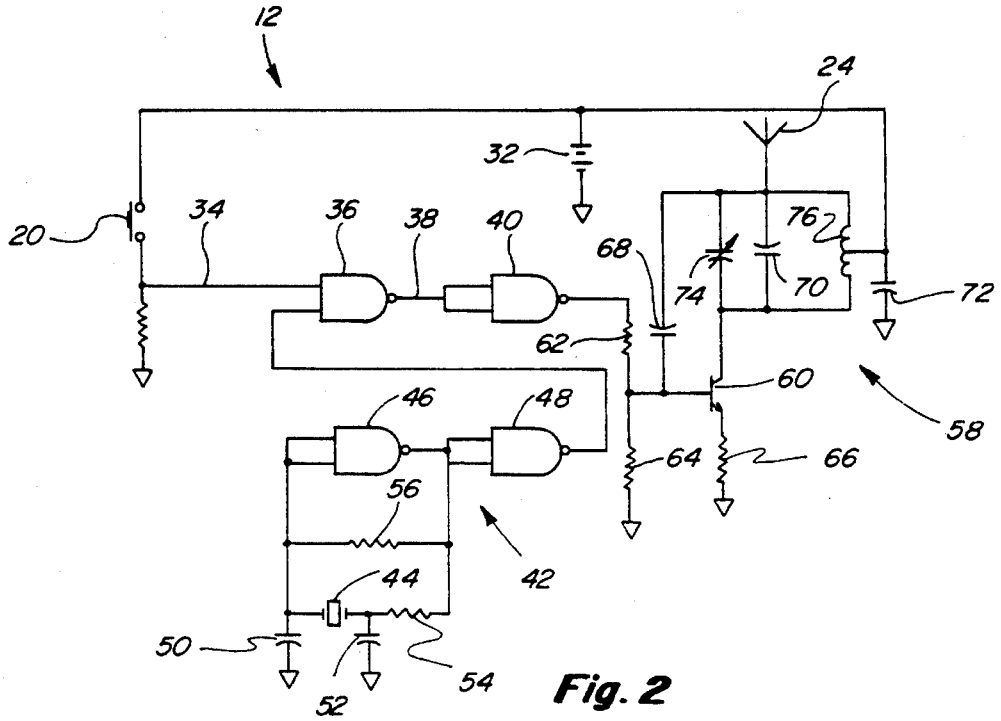
FIG. 2 is a schematic diagram of a transmitter portion of the means for locating a remote control device.

Referring now to FIG. 2, a schematic diagram of the transmitter portion 12 of the locating means 10 is shown. The transmitter portion 12 includes a power source such as a battery 32 which may be incorporated within the electronic device 16. The transmitter portion 12 may optionally be connected to the power supply (not shown) of the electronic device 16. The switch 20 is connected via a wire 34 to an input of an NAND gate 36. NAND gate 36 provides an output over a wire 38 to inputs of an NAND gate 40. Both of the inputs of NAND gate 40 are coupled together. NAND gate 36 has another input connected to a timing circuit 42. Timing circuit 42 includes a crystal 44 which provides signals to a pair of NAND gates 46 and 48. The crystal 44 oscillates at a frequency of 32.77 kHz. The timing circuit 42 also includes a pair of capacitors 50 and 52 and a pair of resistors 54 and 56 to filter the signals provided from the crystal 44.

The output of NAND gate 40 is provided to an oscillator circuit 58 which is comprised of transistor 60, resistors 62, 64, and 66, capacitors 68, 70, and 72, variable capacitor 74, and variable inductor 76. The output of NAND gate 40 functions to turn the transistor 60 on and off at a rate of 32.77 kHz. When on, the transistor 60 oscillates at about 320 MHz. The oscillator circuit 58 is connected to the antenna 24.

When the remote control device 18 is lost or misplaced the user of the electronic device 16 presses the switch 20 which is located on the exterior of the electronic device 16. Once the switch 20 is operated signals are sent from NAND gate 40 to turn on and off the transistor 60 of the oscillator circuit 58. As stated above, when on the transistor 60 oscillates at about 320 MHz. This signal is sent out over the antenna 24 to be received by the receiver portion 14.

Figure 3:
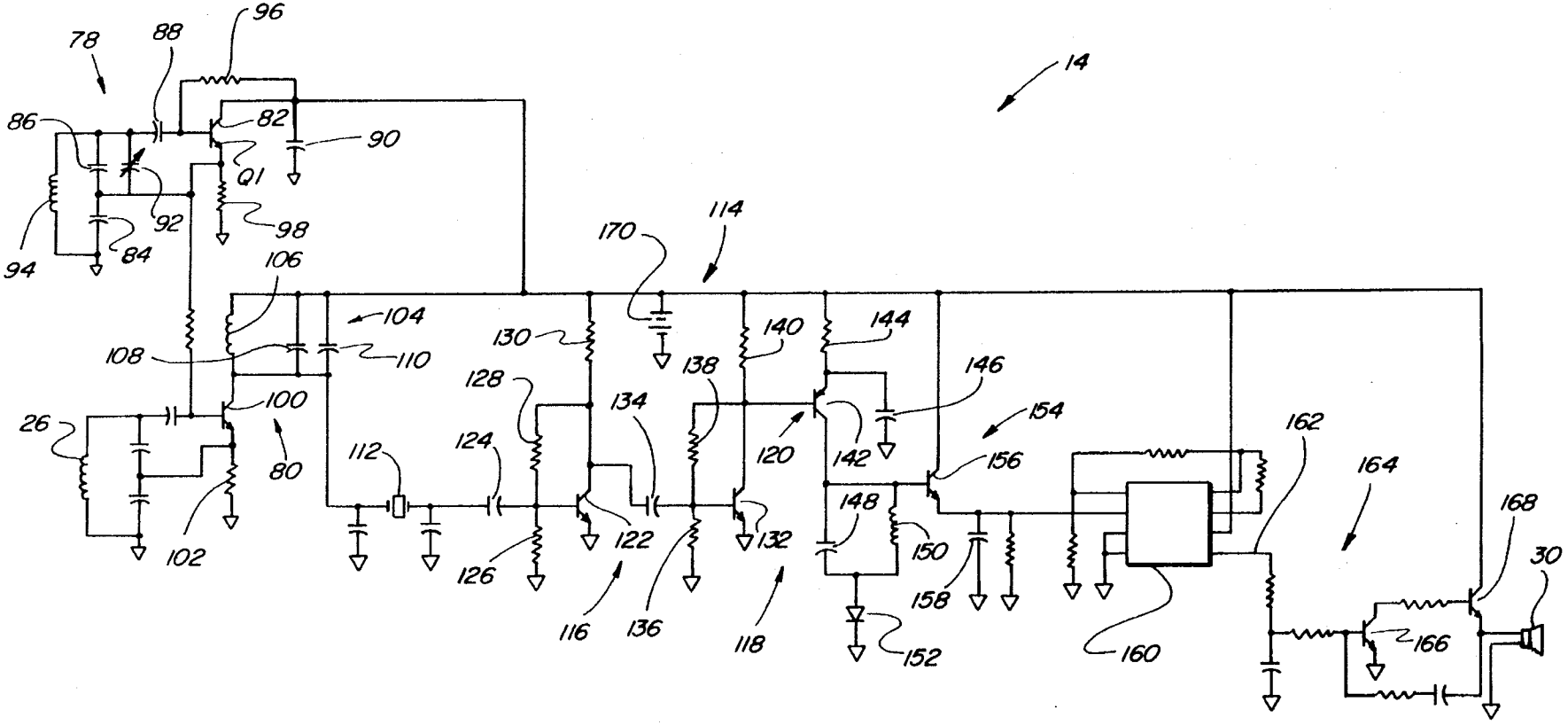
FIG. 3 is a schematic diagram of a receiver portion of the means for locating a remote control device.

Referring now to FIG. 3, a schematic diagram of the receiver portion 14 of the locating means 10 is illustrated. The receiver portion 14 comprises the coil 26 connected to a first oscillator circuit 78 and a second oscillator circuit 80. The first oscillator circuit 78 comprises a transistor 82, four capacitors 84, 86, 88, and 90, a variable capacitor 92, an inductor 94, and resistors 96 and 98. The second oscillator circuit 80 comprises a transistor 100 and a resistor 102. The second oscillator circuit 80 is connected to a tank circuit 104. The tank circuit 104 includes an inductor 106 and a pair of capacitors 108 and 110. The tank circuit 104 is connected to a crystal 112 which oscillates at a frequency of 32.77 kHz. The crystal 112 is connected to an amplification circuit 114. The amplification circuit 114 comprises a first amplification stage 116, a second amplification stage 118, and a third amplification stage 120. The first amplification stages 116 includes a transistor 122, capacitor 124, and resistors 126, 128, and 130. The second amplification stage 118 includes a transistor 132, capacitor 134, and resistors 136, 138, and 140. The third amplification stage 120 includes a transistor 142, resistor 144, capacitors 146 and 148, inductor 150, and a diode 152. The third amplification stage 120 is connected to a sensitivity detector 154 which comprises a transistor 156. The output of the transistor 156 is connected to a capacitor 158. The output of capacitor 158 is provided to a chip 160 which is designated as an MAX921. The output of chip 160 is provided over a wire 162 to an audio oscillator circuit 164 which includes a pair of transistors 166 and 168 and other associated circuit components. The output of transistor 168 is connected to the speaker 30. Additionally, a battery 170 is provided to power the receiver portion 14. The battery 170 may also be the battery which powers the remote control device 18.

The receiver portion 14 is adapted to operate in the following manner. An oscillator circuit takes a finite time to build up oscillations and any noise or signal will cause the oscillator circuit to start faster. If there is a signal from the transmitter portion 12 which develops a voltage across the coil 26 and the signal is exactly or nearly the design center frequency of the first oscillator circuit's 78 natural frequency then the first oscillator circuit 78 will start faster. The faster starting first oscillator circuit 78 will cause more current to flow through the tank circuit 104. The first oscillator circuit 78 turns the second oscillator circuit 80 on and off at a rate of 1 MHz. Without the presence of an external signal, there is not enough time for the second oscillator circuit 80 to fully start. Once the second oscillator circuit 80 begins to oscillate the 32.77 kHz signal from the crystal 112 is provided to the amplification circuit 114 which amplifies this signal by about 80 dB. This amplified signal is sent to the sensitivity detector 154 which charges the capacitor 158. If the signal is strong enough to build up the charge on the capacitor 158 to the threshold voltage of the chip 160 then the output of the chip 160 will go high and be sent out over the wire 162 to turn on the audio oscillator 164. When the audio oscillator 164 is turned on this will operate the speaker 30 to provide an audible signal.

Figure 4:
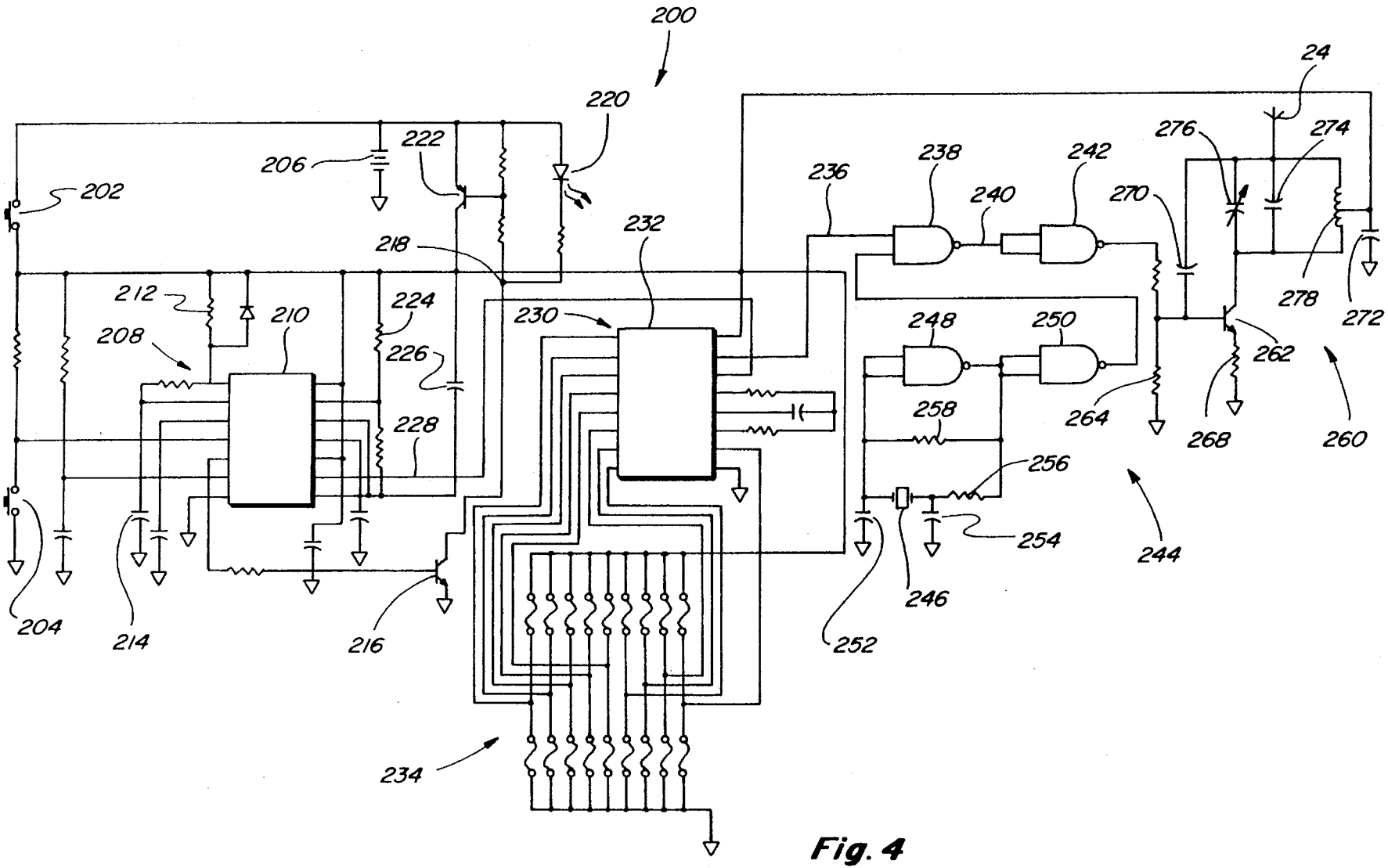
FIG. 4 is a schematic diagram of another embodiment of a transmitter portion of the means for locating a remote control device.

FIG. 4 illustrates another embodiment of the transmitter portion of the locating means 10 of the present invention. A transmitter portion 200 is shown which comprises a pair of selection switches 202 and 204 connected to a power source such as a battery 206 which may be part of the electronic device 16. Additionally, the transmitter portion 200 may optionally be connected to the power supply (not shown) of the electronic device 16. The switch 202 is connected to a timer circuit 208 which comprises a chip 210 designated as an LMC556. The timer circuit 208 also includes a resistor 212 and a capacitor 214. A first output of the chip 210 is provided to a transistor 216 which has its collector connected to a node 218. An LED (light emitting diode) 220 is connected between the battery 206 and the node 218. A transistor 222 is connected between the battery 206 and the timer circuit 208. A resistor 224 and a capacitor 226 are also connected to the chip 210. A second output of the chip 210 is provided over a wire 228 to a code circuit 230 which comprises a chip 232 designated as an SC41342 and a set of fusible links 234. The fusible links 234 are connected to the inputs of the chip 232. The fusible links 234 provide a particular code that is unique to the transmitter portion 200. The code is set by either leaving in the links or by burning out the links. In this manner and with the number of fusible links 234 shown in FIG. 4 it is possible to choose between about 19,000 different codes. Additionally, the operation and theory of the chip 232 is explained in Motorola's data book entitled "CMOS APPLICATION SPECIFIC STANDARD ICs."

The chip 232 has an output which is sent over a wire 236 to an input of an NAND gate 238. The signal from the output of the chip 232 is a serial logic bit stream. NAND gate 238 provides an output over a wire 240 to an NAND gate 242. NAND gate 242 has both of its inputs coupled together. NAND gate 238 has another input connected to a timing circuit 244. The timing circuit 244 includes a crystal 246 which provides signals to a pair of NAND gates 248 and 250. The crystal 246 oscillates at a frequency of 32.77 kHz. The timing circuit 244 also includes a pair of capacitors 252 and 254 and a pair of resistors 256 and 258 to filter the signals provided from the crystal 246.

The output of NAND gate 242 is provided to an oscillator circuit 260 which is comprised of transistor 262, resistors 264, 266, and 268, capacitors 270, 272, and 274, variable capacitor 276, and variable inductor 280. The output of NAND gate 242 will turn the transistor 262 of the oscillator circuit 260 on and off at a rate of 32.77 kHz. When on, the transistor 262 oscillates at about 320 MHz. This coded signal is then sent out over the antenna 24.

Figure 5:
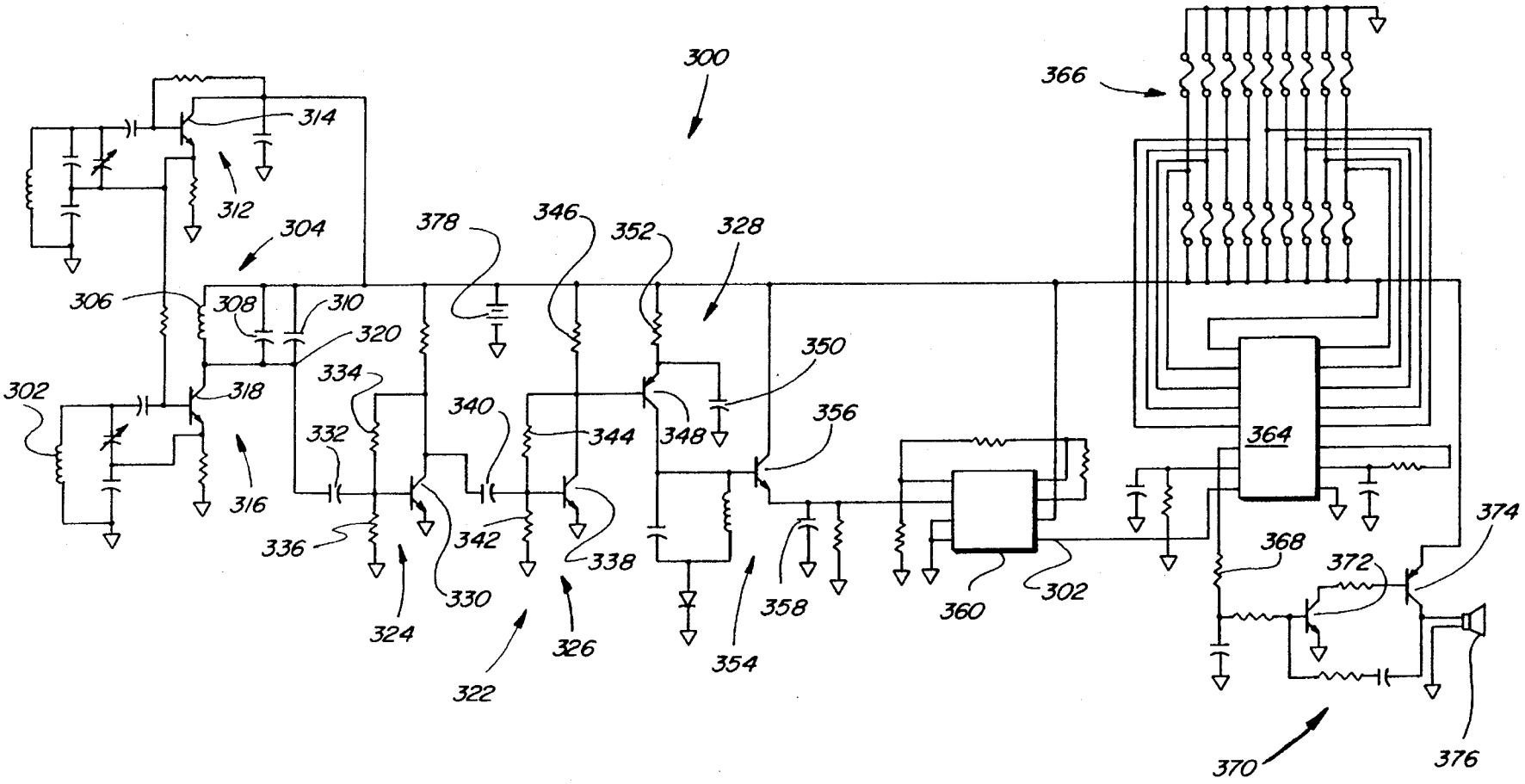
FIG. 5 is a schematic diagram of another embodiment of a receiver portion of the means for locating a remote control device.

Referring now to FIG. 5, another embodiment of the receiver portion of the locating means 10 is shown. A receiver portion 300 is illustrated which comprises a coil 302 and a tank circuit 304. The tank circuit 304 includes an inductor 306 and a pair of capacitors 308 and 310. The coil 302 is also connected to a first oscillator circuit 312 which comprises a transistor 314 and a second oscillator circuit 316 which comprises a transistor 318 and which is also connected to the tank circuit 304. The output of the tank circuit 304 appears at a node 320 and is provided to an amplification circuit 322. The amplification circuit 322 includes a first amplification stage 324, a second amplification stage 326, and a third amplification stage 328. The first amplification stage 324 has a transistor 330, a capacitor 332, and a pair of resistors 334 and 336. The second amplification stage 326 includes a transistor 338, a capacitor 340, and resistors 342, 344, and 346. The third amplification stage 328 comprises a transistor 348, a capacitor 350, and a resistor 352.

The third amplification stage 328 is connected to a sensitivity circuit 354 which comprises a transistor 356. The output of the sensitivity circuit 354 is provided to a capacitor 358. The capacitor 358 is connected to an input of a chip 360 which is designated as an MAX921. The output of chip 360 is sent over a wire 362 to a chip 364 which is designated as an SC41344. A set of fusible links 366 are connected to the inputs of the chip 364. The fusible links 366 are coded to match the setting of the fusible links 228 of the transmitter portion 200 shown in FIG. 4. An output of the chip 364 is provided over a wire 368 to an audio oscillator circuit 370. The audio oscillator circuit 370 comprises a pair of transistors 372 and 374. The transistor 374 is connected to a speaker 376.

A battery 378 is also shown in FIG. 5 connected between the first and second amplification stages 324 and 326. The battery 378 may be the battery which is typically included in the remote control 18 to power the remote control 18.

The transmitter portion 200 as shown in FIG. 4 operates with the receiver portion 300 as shown in FIG. 5 in the following manner. In the event that the remote control 18 is lost or misplaced, the user of the electronic device 16 presses the switch 202 which is located on the exterior of the electronic device 16. When the switch 202 is actuated, the chip 210 sends an output signal to the transistor 216 which turns on the transistors 216 and 222 and the LED 220. This also holds on the DC signal supplied by the battery 206 to the various circuits. The LED 220 acts as a visual indicator to alert the user that the locating means 10 has been activated and is in use. The voltage provided by the battery 206 will remain high for a time period determined by either the RC time constant of resistor 212 and capacitor 214 or prior to the expiration of this time period by pushing the switch 204. Pressing the switch 204 in effect overrides the predetermined time period established by the RC time constant, turns the LED 220 off, and resets the transmitter portion 12.

During the period in which the chip 210 is active it will output a pulse over the wire 228 about every few seconds to the chip 232. This time period is determined by the RC time constant of resistor 224 and capacitor 226. Each time the input to chip 232 from the chip 210 is pulled low, chip 232 will put out a burst of logic pulses that will turn on and off the NAND gate 242. The 32.77 kHz signal out of the NAND gate 242 will turn the transistor 262 of the oscillator circuit 260 on and off at a rate of 32.77 kHz. When on, the transistor 262 oscillates at about 320 MHz. This 320 MHz RF signal having a repetition rate of 32.77 kHz is sent out through the antenna 24 to the receiver portion 300. The chip 232 sends out a serial bit stream with a code dependent upon how the fusible links 234 were set.

Once a signal is transmitted by the transmitter portion 200 it will be received by the receiver portion 300 in the following manner. The received signal develops a voltage across the coil 302 and if the signal is exactly or nearly the design center frequency of the oscillator circuit's 312 natural frequency the oscillator circuit 312 will begin to oscillate. The oscillator circuit 312 turns on and off the oscillator circuit 316 at a rate of about 1 MHz. Without the presence of an external signal the oscillator circuit 316 does not have enough time to get fully started. Once the oscillator circuit 316 begins to oscillate the 32.77 kHz signal appears across the tank circuit 304. The signal is then amplified by about 80 dB by the amplification stages 324, 326, and 328 of the amplification circuit 322. The amplified signal is then provided to the sensitivity circuit 354 to charge the capacitor 358. If the signal is strong enough to build up the charge on the capacitor 358 to the threshold voltage of the chip 360 then the chip 360 will output a signal over wire 362 to the input of the chip 364. If the proper code is input to the chip 364 then the chip 364 will send an output over wire 368 to the audio oscillator 370 to operate the speaker 376. Once the speaker 376 emits sounds the user may locate the lost or misplaced remote control 18. Once the remote control 18 is found, the user may press the switch 204 on the electronic device 16 to stop the speaker from emitting sounds. In the event the remote control 18 was not located within the predetermined time period established by the RC time constant of resistor 212 and capacitor 214, the switch 202 may be pressed again to start the locating process.

Figure 6:
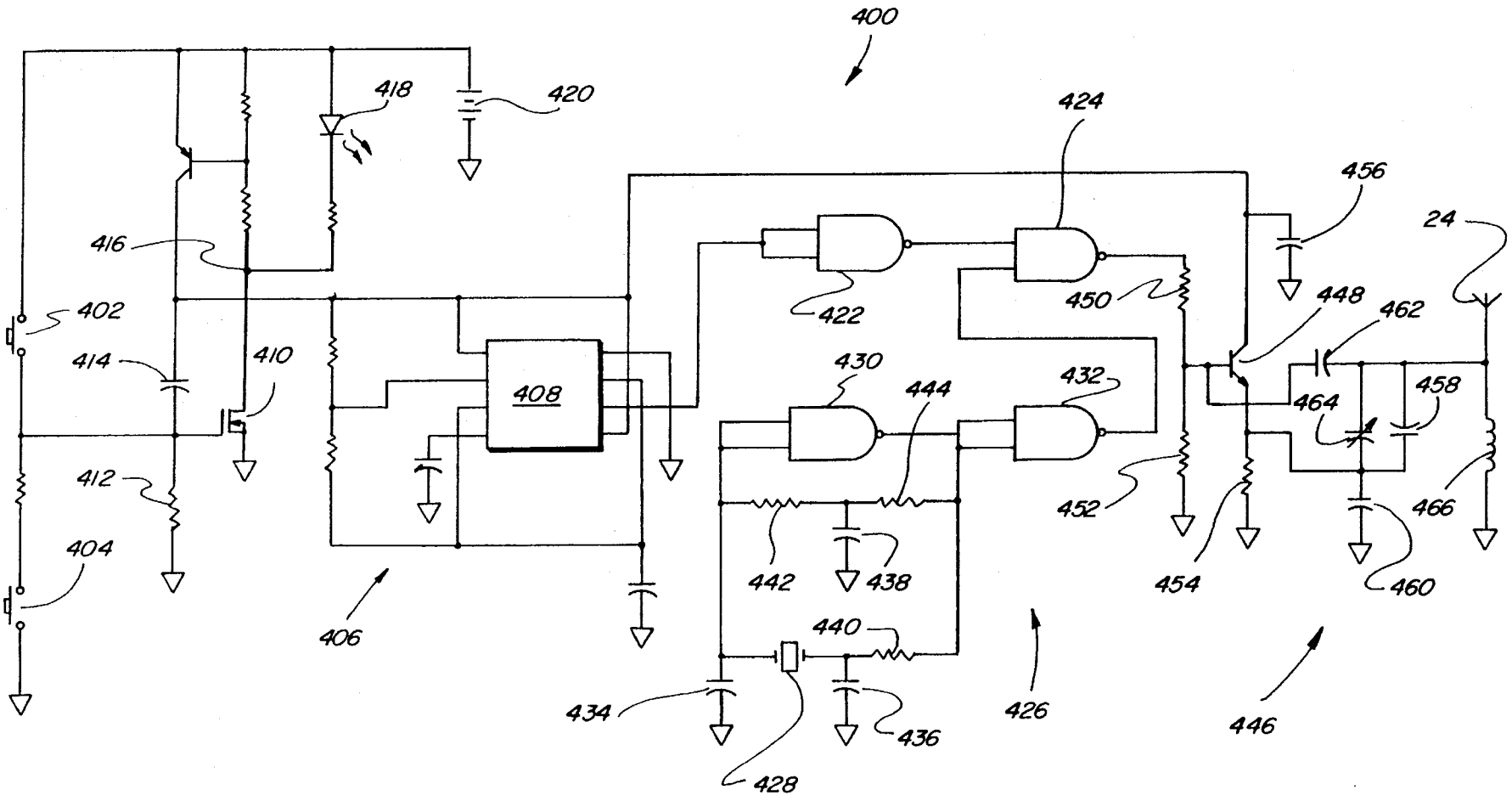
FIG. 6 is a schematic diagram of another embodiment of a receiver portion of the means for locating a remote control device.

FIG. 6 shows another embodiment of the transmitter portion of the locating means 10. A transmitter portion 400 is shown which includes a first selection switch 402 and a second selection switch 404. The first and second selection switches 402 and 404 are connected to a timing circuit 406. The timing circuit 406 comprises a chip 408 designated as an LM555, an MOSFET (metal oxide semiconductor field effect transistor) transistor 410, a resistor 412, and a capacitor 414. The gate of the MOSFET 410 is connected to a node 416. An LED 418 is connected between the node 416 and a battery 420. As was previously explained, the battery 420 may be part of the electronic device 16 or the transmitter portion 400 may optionally be connected to the power supply (not shown) of the electronic device 16.

An output of the timer chip 408 is connected to both inputs of an NAND gate 422. The output of NAND gate 422 is provided to an input of another NAND gate 424. The other input of NAND gate 424 is connected to a timing circuit 426. The timing circuit 426 includes a crystal 428 which provides signals to a pair of NAND gates 430 and 432. The crystal 428 oscillates at a frequency of 32.77 kHz. The timing circuit 426 also includes three capacitors 434, 436, and 438 and three resistors 440, 442 and 444 to filter the signals provided from the crystal 428.

The output of NAND gate 424 is provided to an oscillator circuit 446 which is comprised of a transistor 448, three resistors 450, 452, and 454, four capacitors 456, 458, 460, and 462, a variable capacitor 464, and an inductor 466. The oscillator circuit 446 is connected to the antenna 24. The output of NAND gate 424 will turn the transistor 448 on and off at a rate of 32.77 kHz. When on, the transistor 448 oscillates at about 320 MHz. It is to be understood that the transmitter portion 400, as shown in FIG. 6, is a compromise between the transmitter portion 12 shown in FIG. 2 and the transmitter portion 200 shown in FIG. 4.

The transmitter portion 400, as shown in FIG. 6, will be operated in the event the remote control device 18 is lost or misplaced. The user of the electronic device 16 presses the switch 402 to activate the transmitter portion 400. When the switch 402 is pressed, the RC time constant established by resistor 412 and capacitor 414 will hold on the transistor 410 for a predetermined period of time and will also hold on the LED 418. The voltage provided by the battery 420 to the chip 408 will remain present until either the predetermined time period of resistor 412 and capacitor 414 expires or the activation of the switch 404. Pressing the switch 404 in effect overrides the predetermined time period established by the RC time constant of resistor 412 and capacitor 414, turns off the LED 418, and resets the transmitter portion 400. During the period in which the chip 408 is active the NAND gate 424 will turn on and off. The 32.77 kHz signal out of the NAND gate 424 will turn the transistor 448 of the oscillator circuit 446 on and off at a rate of 32.77 kHz. When on, the transistor 448 oscillates at about 320 MHz. This 320 MHz RF signal having a repetition rate of 32.77 kHz is sent out over the antenna 24.

From all that has been said, it will be clear that there has been thus shown and described herein a locating means for a remote control which fulfills the various objects and advantages sought therefor. It will be apparent to those skilled in the art, however, that many changes, modifications, variations, and other uses and applications of the subject locating means are possible and contemplated. All changes, modifications, variations, and other uses and applications which do not depart from the spirit and scope of the invention are deemed to be covered by the invention, which is limited only by the claims which follow.

What is claimed is:

1. Means for locating a remote control device which is capable of controlling an electronic device, the electronic device being stationary and the remote control device being capable of controlling the electronic device from a remote location, the locating means comprising:

a transmitter portion incorporated with the electronic device, the transmitter portion comprising means for generating a signal for a predetermined period of time, means for transmitting the signal, visual indicating means responsive to the generating means for visually indicating transmission of the signal, and means for stopping the transmission of the signal prior to the expiration of the predetermined period of time and the visual indicating means; and a receiver portion located within the remote control device, the receiver portion comprising means for receiving the transmitted signal, a first oscillator means for receiving the signal from the receiving means and the first oscillator means having a design center frequency, the first oscillator means adapted to oscillate when the transmitted signal is at the design center frequency of the first oscillator means, a second oscillator means responsive to the first oscillator means oscillating, the second oscillator means adapted to oscillate after the first oscillator means begins to oscillate, means for amplifying the signal from the second oscillator means, and means for providing the amplified signal to an audio oscillator means, the audio oscillator means for generating audio signals indicating that the signal has been received.

2. The locating means of claim 1 wherein the first oscillator means comprises an oscillator circuit having a transistor.

3. The locating means of claim 1 wherein the second oscillator means comprises an oscillator circuit having a transistor.

4. The locating means of claim 1 wherein the indicating means is a visual indicating means.

5. The locating means of claim 4 wherein the visual indicating means is an LED.

6. Means for locating a remote control device which is capable of controlling an electronic device, the electronic device being stationary and the remote control device being capable of controlling the electronic device from a remote location, the locatin means comprising:

a transmitter portion incorporated with the electronic device, the transmitter portion comprising means for generating a signal for a predetermined period of time, means for transmitting the signal, and means for stopping the transmission of the signal prior to the expiration of the predetermined period of time; and a receiver portion located within the remote control device, the receiver portion comprising means for receiving the transmitted signal, a first oscillator means for receiving the signal from the receiving means and the first oscillator means having a design center frequency, the first oscillator means adapted to oscillate when the transmitted signal is at the design center frequency of the first oscillator means, a second oscillator means responsive to the first oscillator means oscillating, the second oscillator means adapted to oscillate after the first oscillator means begins to oscillate, means for amplifying the signal from the second oscillator means, and means for providing the amplified signal to an audio oscillator means, the audio oscillator means for generating audio signals indicating that the signal has been received.

7. The locating means of claim 6 wherein the first oscillator means comprises an oscillator circuit having a transistor.

8. The locating means of claim 6 wherein the second oscillator means comprises an oscillator circuit having a transistor.

9. The locating means of claim 6 wherein the transmitting portion further comprises means for indicating that the generating means has been activated.

10. The locating means of claim 9 wherein the indicating means is a visual indicating means.

11. The locating means of claim 10 wherein the visual indicating means is an LED.

12. The locating means of claim 6 wherein the means for stopping transmission comprises a switch for resetting the generating means.

13. The locating means of claim 6 wherein the transmitting means comprises a switch for starting the generating means.

14. Means for locating a remote control device which is capable of controlling an electronic device, the electronic device being stationary and the remote control device being capable of controlling the electronic device from a remote location, the locating means comprising:

a transmitter portion incorporated with the electronic device, the transmitter portion comprising means for generating a signal for a predetermined period of time, means for coding the signal, the coding means comprising a set of fusible links for selecting a code, the code being selected by inserting or removing any or all of the fusible links, means for transmitting the coded signal, and means for stopping the transmission of the coded signal prior to the expiration of the predetermined period of time; and a receiver portion located within the remote control device, the receiver portion comprising means for receiving the transmitted coded signal, a first oscillator means for receiving the coded signal from the receiving means and the first oscillator means having a design center frequency, the first oscillator means adapted to oscillate when the transmitted coded signal is at the design center frequency of the first oscillator means, a second oscillator means responsive to the first oscillator means oscillating, the second oscillator means adapted to oscillate after the first oscillator means begins to oscillate, means for amplifying the coded signal from the second oscillator means, means for determining that the coded signal has been received, the determining means comprising means for comparing the coded signal to a code, means for verifying that the coded signal corresponds to the code, and means for providing a signal to an audio oscillator means once the coded signal has been verified, the audio oscillator means for generating audio signals indicating that the coded signal has been received and verified.

15. The locating means of claim 14 wherein the transmitter portion further comprises means for indicating that the generating means has been activated.

16. The locating means of claim 14 wherein the comparing means comprises a set of fusible links for selecting the code, the code being selected by inserting or removing any or all of the fusible links.

17. The locating means of claim 16 wherein the code selected by the comparing means is the same as the code selected by the coding means of the transmitter portion.

18. The locating means of claim 14 wherein the means for stopping transmission comprises a switch for resetting the generating means.

19. The locating means of claim 14 wherein the transmitting means comprises a switch for starting the generating means.

* * * * *